US008244524B2

(12) United States Patent
Shirakawa et al.

(10) Patent No.: US 8,244,524 B2
(45) Date of Patent: Aug. 14, 2012

(54) SBR ENCODER WITH SPECTRUM POWER CORRECTION

(75) Inventors: Miyuki Shirakawa, Fukuoka (JP); Masanao Suzuki, Kawasaki (JP); Yoshiteru Tsuchinaga, Fukuoka (JP); Takashi Makiuchi, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 278 days.

(21) Appl. No.: 12/654,591

(22) Filed: Dec. 23, 2009

(65) Prior Publication Data

US 2010/0106511 A1 Apr. 29, 2010

Related U.S. Application Data

(63) Continuation of application No. PCT/JP2007/063395, filed on Jul. 4, 2007.

(51) Int. Cl.
*G10L 19/14* (2006.01)

(52) U.S. Cl. ..... 704/205

(58) Field of Classification Search ..... 704/205, 704/500–504

See application file for complete search history.

(56) References Cited

U.S. PATENT DOCUMENTS

| | | | | |
|---|---|---|---|---|
| 4,972,484 | A | 11/1990 | Theile et al. | |
| 5,590,108 | A | 12/1996 | Mitsuno et al. | |
| 6,029,134 | A * | 2/2000 | Nishiguchi et al. | 704/268 |
| 6,138,101 | A | 10/2000 | Fujii | |
| 6,370,499 | B1 * | 4/2002 | Fujii | 704/200.1 |
| 7,483,836 | B2 | 1/2009 | Taori et al. | |
| 7,516,074 | B2 * | 4/2009 | Bilobrov | 704/270 |
| 7,546,240 | B2 * | 6/2009 | Mehrotra et al. | 704/230 |
| 2005/0198061 | A1 * | 9/2005 | Robinson et al. | 707/102 |
| 2005/0259819 | A1 * | 11/2005 | Oomen et al. | 380/200 |
| 2005/0267744 | A1 | 12/2005 | Nettre et al. | |
| 2007/0016405 | A1 * | 1/2007 | Mehrotra et al. | 704/203 |
| 2007/0055500 | A1 * | 3/2007 | Bilobrov | 704/217 |
| 2010/0153099 | A1 | 6/2010 | Goto et al. | |

FOREIGN PATENT DOCUMENTS

| | | |
|---|---|---|
| JP | 1-501435 | 5/1989 |
| JP | 6-318875 | 11/1994 |
| JP | 7-50589 | 2/1995 |
| JP | 7-170194 | 7/1995 |
| JP | 10-207489 | 8/1998 |

(Continued)

OTHER PUBLICATIONS

International Search Report for PCT/JP2007/063395, mailed Oct. 16, 2007.

(Continued)

*Primary Examiner* — Michael N Opsasnick
(74) *Attorney, Agent, or Firm* — Fujitsu Patent Center

(57) ABSTRACT

An encoding apparatus including an SBR (Spectral Band Replication) encoder creates high-frequency-component encoded data with reduced bits. The encoding apparatus converts an input signal into a frequency-domain spectrum signal, divides the converted spectrum signal into an arbitrary number of segments with respect to a time axis and a frequency axis, calculates a spectrum power of each segment and a feature parameter that represents a feature of the corresponding spectrum power, calculates a masking threshold using the calculated spectrum power of each segment, detects a segment having a spectrum power equal to or less than the calculated masking threshold, corrects the spectrum power of the detected segment, and encodes both the corrected spectrum power and the calculated feature parameter. The correction reduces a difference between quantization values, reducing the number of encoded bits.

16 Claims, 11 Drawing Sheets

FOREIGN PATENT DOCUMENTS

| | | |
|---|---|---|
| JP | 2000-293199 | 10/2000 |
| JP | 2001-282288 | 10/2001 |
| JP | 2001-343998 | 12/2001 |
| JP | 2002-268693 | 9/2002 |
| JP | 2004-522198 | 7/2004 |
| JP | 2005-258158 | 9/2005 |
| JP | 2005-338637 | 12/2005 |
| JP | 2007-104598 | 4/2007 |
| WO | 88/04117 | 6/1988 |
| WO | 02/091363 | 11/2002 |
| WO | WO-2007/037359 A1 | 4/2007 |

OTHER PUBLICATIONS

Japanese Office Action mailed Nov. 22, 2011 for corresponding Japanese Application No. 2009-521487, with partial English-language translation.

* cited by examiner

SBR ENCODER WITH SPECTRUM POWER CORRECTION

CROSS-REFERENCE TO RELATED APPLICATION(S)

This application is a continuation of International Application No. PCT/JP2007/063395, filed on Jul. 4, 2007, the entire contents of which are incorporated herein by reference.

FIELD

The embodiments discussed herein are directed to an encoding apparatus and an encoding method that divide an input signal into frames that are formed from samples and create high-frequency-component encoded data by encoding a high frequency band in the input signal.

BACKGROUND

Audio encoding technologies are widely used to compress or decompress audio signals, such as voice and music. In audio encoding technologies, various techniques have been proposed to increase the compression efficiency, i.e., reduce the number of bits after encoding, which creates a problem with degradation of sound quality after encoding.

Various technologies have been disclosed to prevent the degradation of the sound quality after encoding (see Japanese Laid-open Patent Publication No. 2001-282288). Moreover, high-efficiency advanced audio coding (HE-AAC), which is used in MPEG-2 and offers high compression efficiency while preventing degradation of the sound quality, has been recently used.

A typical HE-AAC encoding apparatus using HE-AAC includes a spectral band replication (SBR) unit that encodes a high frequency component; and an advanced audio coding (AAC) unit that encodes a low frequency component.

More particularly, the HE-AAC encoding apparatus creates high-frequency-component encoded data by encoding the high frequency component using the SBR encoding unit and low-frequency-component encoded data by encoding the low frequency component using the AAC encoding unit. The HE-AAC encoding apparatus then creates an HE-AAC bitstream by multiplexing the created high-frequency-component encoded data and the created low-frequency-component encoded data.

FIG. 12 is a functional block diagram of the configuration of a conventional encoding apparatus. As illustrated in FIG. 12, the encoding apparatus includes an SBR encoder, an AAC encoder, and a bitstream creating unit.

The AAC encoder uses a technology that encodes data in a frequency domain that is obtained by converting input data. The AAC encoder creates the low-frequency-component encoded data from a low-frequency-band signal contained in the input signal. More particularly, the AAC encoder obtains the low-frequency-band input signal by downsampling the input signal, divides the obtained low-frequency-band input signal into segments at fixed intervals, and encodes each of the segments, thereby creating the AAC encoded data.

The SBR encoder performs data compression by compressing data that is required to replicate the high frequency component from the low frequency component contained in the received input signal. More particularly, the SBR encoder creates a segment zone (time/frequency grid) by dividing the input signal into segments with respect to the time axis and the frequency axis depending on the property of the input signal (the magnitude of change in the signal). The SBR encoder then calculates the spectrum power within the created time/frequency grid and data unreplicable from the low frequency component and quantizes them both. After that, the SBR encoder converts data on the difference between quantization values of adjacent grids into a Huffman code and creates the SBR encoded data by encoding the high frequency component contained in the input signal.

The HE-AAC encoding apparatus multiplexes the high-frequency-component encoded data and the low-frequency-component encoded data using both the SBR encoded data that is created by the SBR encoder and the AAC encoded data that is created by the AAC encoder, thereby creating the HE-AAC bitstream.

There is a problem in that the conventional HE-AAC encoding apparatus cannot reduce the number of bits used in the SBR encoding.

With a conventional HE-AAC encoding apparatus, the total number of encoding bits available in the HE-AAC is determined by the bit rate. In other words, the sum of the number of bits available for the AAC encoder and the number of bits available for the SBR encoder is predetermined by the HE-AAC encoding apparatus. Therefore, if the HE-AAC encoding apparatus uses a low bit rate, the total number of available encoding bits is low.

The AAC encoder can appropriately control the quantization error and the number of encoding bits during the encoding. There is a trade off in the AAC encoder with regard to the relationship between the quantization error and the number of encoding bits. In other words, a low number of bits causes an increase in the quantization error and degradation of the sound quality, while a high number of bits causes a decrease in the quantization error and an improvement in the sound quality.

In contrast, with the SBR encoding, there are no specified ways of controlling the number of bits used in the SBR, i.e., the number of encoding bits varies depending on the property of the input signal. In other words, if the number of bits used in the SBR encoding increases, the number of bits available in the AAC encoding decreases, which increases the quantization error in the AAC encoding. As a result, when the conventional HE-AAC encoding apparatus decodes the high-frequency-component encoded data and the low-frequency-component encoded data and outputs the decoded data as voice, degradation of the total quality of the voice occurs.

SUMMARY

According to an aspect of an embodiment of the invention, an encoding apparatus for dividing an input signal into frames that are formed from samples and creating high-frequency-component encoded data by encoding a high frequency band in the input signal, includes a dividing unit that converts the input signal into a frequency-domain spectrum signal and divides the frequency-domain spectrum signal into an arbitrary number of segments with respect to a time axis and a frequency axis; a threshold calculating unit that calculates a spectrum power of each of the segments and calculates a masking threshold using the calculated spectrum power of each segment; and a power correcting unit that detects a segment having the spectrum power equal to or less than the calculated masking threshold and corrects the spectrum power of the detected segment.

The object and advantages of the embodiment will be realized and attained by means of the elements and combinations particularly pointed out in the claims.

It is to be understood that both the foregoing general description and the following detailed description are exemplary and explanatory and are not restrictive of the embodiment, as claimed.

DESCRIPTION OF EMBODIMENTS

Figure 1:
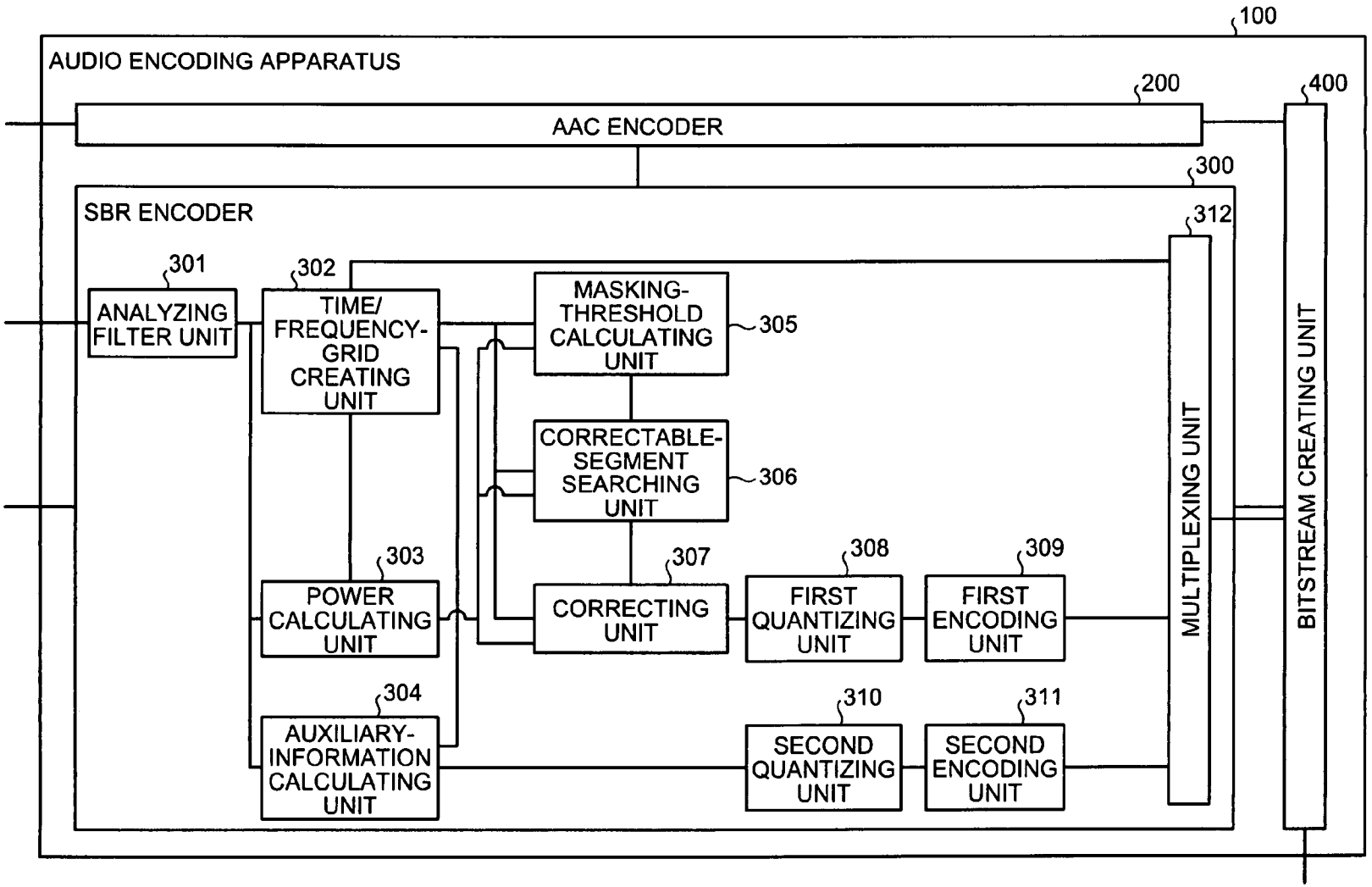
FIG. 1 is a block diagram of the configuration of an audio encoding apparatus according to a first embodiment.

Preferred embodiments of the present invention will be explained with reference to accompanying drawings. In the following section, the outline and features of an audio encoding apparatus according to a first embodiment, the configuration of the encoding apparatus, and the flow of processes performed by the encoding apparatus are described in this order, and the effects of the present embodiment are then described at the end.

[a] First Embodiment

Description of Terms

First of all, the key terms that are used in the present embodiment are described below. An audio encoding apparatus used in the present embodiment is an encoder that includes an SBR encoder that encodes a high frequency component contained in a received input signal and an AAC encoder that encodes a low frequency component contained in the input signal. The audio encoding apparatus creates an HE-AAC bitstream by multiplexing SBR encoded data that is created by the SBR encoder and AAC encoded data that is created by the AAC encoder.

The SBR encoder performs data compression by compressing data that is required to replicate the high frequency component from the low frequency component contained in the received input signal. More particularly, the SBR encoder creates a segment zone (time/frequency grid) by dividing the input signal into segments with respect to the time axis and the frequency axis depending on the property of the input signal. The SBR encoder then calculates the spectrum power within the created time/frequency grid and data unreplicable from the low frequency component and quantizes them both. After that, the SBR encoder converts data on the difference between quantization values of adjacent grids into a Huffman code and creates the SBR encoded data by encoding the high frequency component contained in the input signal. In the Huffman coding, the number of bits required for the coding decreases as the difference between the quantization values decreases.

The AAC encoder uses a technology that encodes data in a frequency domain that is obtained by converting input data. The AAC encoder creates the low-frequency-component encoded data from a low-frequency-band signal contained in the input signal. More particularly, the AAC encoder obtains the low-frequency-band input signal by downsampling the input signal, divides the obtained low-frequency-band input signal into segments at fixed intervals, and encodes each of the segments, thereby creating the AAC encoded data.

The relation between the number of bits used in the SBR encoder and the number of bits used in the AAC encoder is described below. In the audio encoding apparatus, the number of available bits is predetermined (e.g., Z-number of bits). In the AAC coding, the AAC encoded data for the high frequency component is created using bits (e.g., Y-number of bits) remained unallocated after the SBR coding. If the number of bits used in the SBR coding is "X-number of bits", "Y-number of bits", which is the number of bits available in the AAC coding, satisfies "Y=Z−X". Therefore, if the number of bits used in the SBR coding increases, the number of bits available in the AAC coding decreases, which causes distortion on the encoded data that is created by the AAC encoder.

Upon receiving the HE-AAC bitstream from the audio encoding apparatus, a decoding apparatus (decoder) obtains the low frequency data by decoding the received AAC encoded data, obtains a control signal that is required to create high frequency data by decoding the SBR decoded data, and then creates high frequency data using the obtained low frequency data and the obtained control signal.

In this manner, the decoder creates the high frequency component using the SBR decoded data and a result of decoded AAC (low frequency component); therefore, spectrum distortion in the AAC (low frequency component) causes spectrum distortion in the SBR (high frequency component), which increases the total spectrum distortion and causes degradation of the sound quality. Therefore, the decrease of the number of encoding bits used in the SBR coding and the reduction of the spectrum distortion in the AAC coding are considered to be matters of importance.

Outline and Features of Audio Encoding Apparatus

The outline and features of the audio encoding apparatus according to the first embodiment are described below. The audio encoding apparatus according to the first embodiment includes an SBR encoder that creates SBR encoded data (high-frequency-component encoded data) by encoding a high frequency component contained in a received input signal; an AAC encoder that creates AAC encoded data (low-frequency-component encoded data) by encoding a low frequency component contained in the received input signal; and a bitstream creating unit that multiplexes the created SBR encoded data and the created AAC encoded data.

With this configuration, the audio encoding apparatus according to the first embodiment divides the input signal into frames that are formed from samples and creates the high-frequency-component encoded data by encoding the high frequency band in the input signal, as the outline, and is characterized in reducing the number of bits used in the SBR encoding.

When the audio encoding apparatus according to the first embodiment creates a segment zone (time/frequency grid) by dividing the input signal into segments with respect to the time axis and the frequency axis depending on the property of the input signal, calculates the spectrum power within the created time/frequency grid and data unreplicable from the low frequency component, and quantizes them both, the audio encoding apparatus corrects the spectrum power that is equal to or less than a masking threshold, i.e., spectrum power out of the range of the human hearing. This reduces a difference between the quantization values that are encoded using the Huffman coding, which allows the Huffman coding with a lower number of bits. Consequently, the number of bits used in the SBR encoding is reduced.

Configuration of Audio Encoding Apparatus

The configuration of the audio encoding apparatus according to the first embodiment is described below with reference to the block diagram illustrated in FIG. 1. FIG. 1 is a block diagram of the configuration of the audio encoding apparatus according to the first embodiment. As illustrated in FIG. 1, an audio encoding apparatus 100 includes an AAC encoder 200, an SBR encoder 300, and a bitstream creating unit 400.

AAC Encoder

Upon receiving the input signal, the AAC encoder 200 downsamples the received input signal, encodes the low frequency component obtained by the downsampling, and outputs the AAC encoded data as an AAC output.

More particularly, upon receiving the input signal, the AAC encoder 200 obtains a signal by downsampling the received input signal or sampling the received input signal at a lower frequency, converts the obtained signal into an AAC code, and sends the AAC encoded data to the later-described bitstream creating unit 400 as an AAC output.

Configuration of SBR Encoder

As illustrated in FIG. 1, the SBR encoder 300 includes an analyzing filter unit 301, a time/frequency-grid creating unit 302, a power calculating unit 303, an auxiliary-information calculating unit 304, a masking-threshold calculating unit 305, a correctable-segment searching unit 306, a correcting unit 307, a first quantizing unit 308, a first encoding unit 309, a second quantizing unit 310, a second encoding unit 311, and a multiplexing unit 312.

Upon receiving the input signal, the analyzing filter unit 301 converts the received input signal to a frequency-domain spectrum signal. More particularly, when the audio encoding apparatus 100 received the input signal, the analyzing filter unit 301 converts the input signal into the frequency-domain spectrum signal by calculating a time/frequency spectrum of the received input signal. The analyzing filter unit 301 extracts a high frequency component, which is to be encoded by the SBR encoder 300, from the input signal through the conversion. After that, the analyzing filter unit 301 sends the obtained spectrum signal to the later-described time/frequency-grid creating unit 302, the later-described power calculating unit 303, and the later-described auxiliary-information calculating unit 304.

The time/frequency-grid creating unit 302 divides the received spectrum signal into an arbitrary number of segments with respect to the time axis and the frequency axis. More particularly, the time/frequency-grid creating unit 302 divides the frequency-domain spectrum signal that is received from the analyzing filter unit 301 into the arbitrary number of segments with the time axis and the frequency axis. After that, the time/frequency-grid creating unit 302 creates segment division data about the segments and sends the later-described power calculating unit 303, the later-described auxiliary-information calculating unit 304, the later-described masking-threshold calculating unit 305, the later-described correctable-segment searching unit 306, the later-described correcting unit 307, and the later-described multiplexing unit 312.

The power calculating unit 303 calculates the spectrum power of each of the arbitrary number of the segments. More particularly, the power calculating unit 303 calculates the spectrum power of each of the arbitrary number of the segments that are received from the time/frequency-grid creating unit 302. After that, the power calculating unit 303 sends the calculated spectrum power to the later-described masking-threshold calculating unit 305, the later-described correctable-segment searching unit 306, and the later-described correcting unit 307.

The auxiliary-information calculating unit 304 calculates a feature parameter of the spectrum of each of the arbitrary number of the segments. More particularly, the auxiliary-information calculating unit 304 calculates, using the time/frequency spectrum and the resolution data, the feature parameter of the spectrum, which is data unreplicable from the low frequency component, of each of the arbitrary number of the segments that are received from the time/frequency-grid creating unit 302. After that, the auxiliary-information calculating unit 304 sends the calculated parameter to the later-described second quantizing unit 310.

The masking-threshold calculating unit 305 calculates a masking threshold using the calculated spectrum power of each segment. More particularly, the masking-threshold calculating unit 305 calculates, using the calculated spectrum power of each segment that is received from the power calculating unit 303, the masking threshold that is obtained by combining a minimum sound level within the range of the human hearing in silence and a sound level at which the human cannot hear the sound because of interference by a too-high adjacent spectrum power. After that, the masking-threshold calculating unit 305 sends the calculated masking threshold to the later-described correctable-segment searching unit 306.

Figure 2:
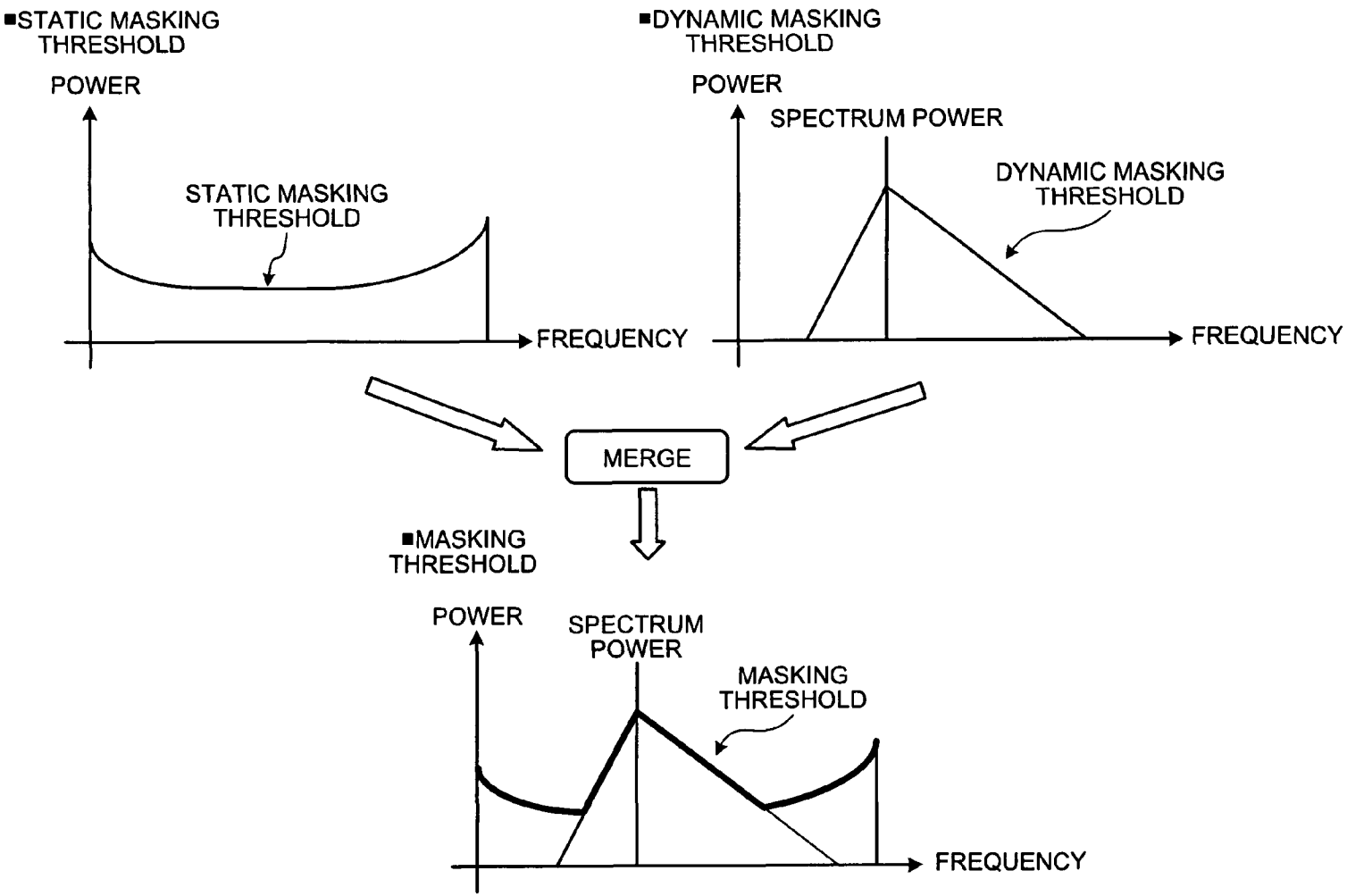
FIG. 2 is a schematic diagram to explain a masking threshold.

As illustrated in FIG. 2, the masking threshold is obtained by merging the static masking threshold (the absolute threshold of hearing), which is the minimum sound level within the range of the human hearing in silent, with the dynamic masking threshold, which is the sound level at which the human cannot hear the sound because the sound is masked by another sound having a too-high level (e.g., the adjacent spectrum power). The masking threshold is the threshold that is obtained by combining the static masking threshold and the dynamic masking threshold and is expressed by, for example, the bold line of FIG. 2. FIG. 2 is a schematic diagram to explain the masking threshold.

Figure 3:
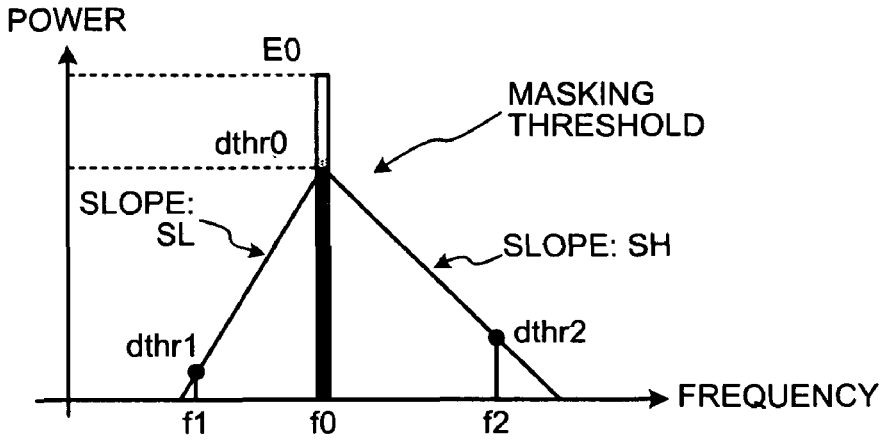
FIG. 3 is a graph to explain how to calculate a dynamic masking threshold.

A manner or calculating the dynamic masking threshold is described below with reference to FIG. 3. FIG. 3 is a graph to explain how to calculate the dynamic masking threshold. As illustrated in FIG. 3, the masking threshold (dthr0) of a sound f0 (spectrum power=E0) given by the sound f0 (by itself) is "dthr0=w(f0)E0". The masking threshold (dthr1) of a sound f1 (f1<f0) given by the sound f0 (spectrum power=E0) is "dthr1=dthr0+SL(f1−f0)". The masking threshold (dthr2) of a sound f2 (f2>f0) given by the sound f0 (spectrum power=E0) is "dthr2=dthr0+SL(f2−f0)". In those equations, w(f), SL and SH are weighting coefficients, and w(f) can be the same value in every frequency or vary depending on the frequency.

Figure 4:
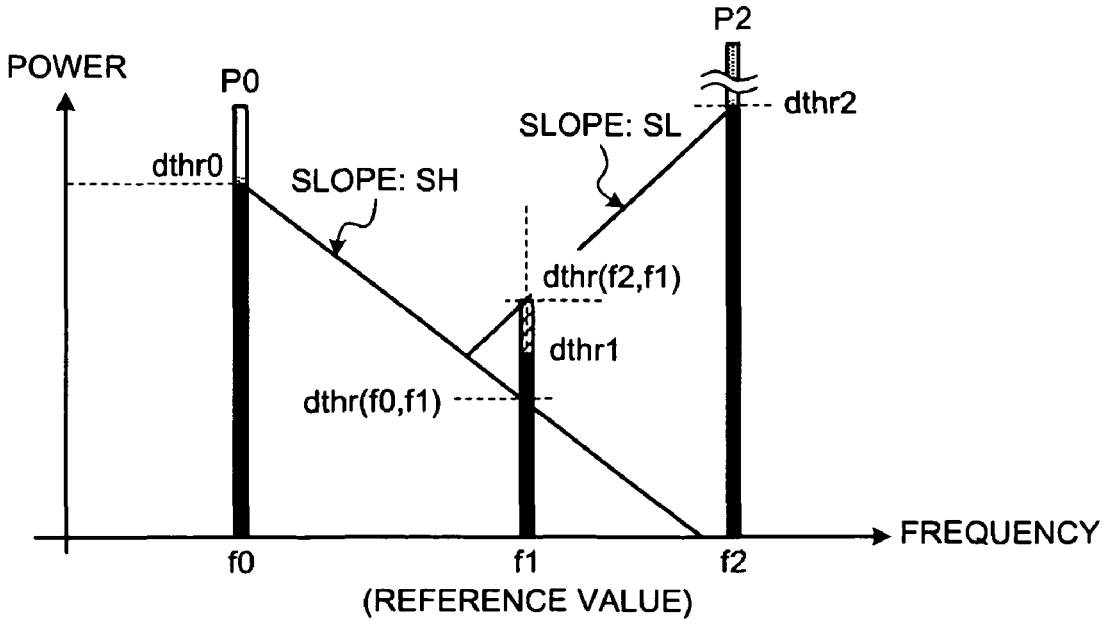
FIG. 4 is a graph to explain calculation for the dynamic masking threshold.

The calculation of the dynamic masking threshold is described with reference to FIG. 4. FIG. 4 is a graph to explain calculation for the dynamic masking threshold. As illustrated in FIG. 4, the masking threshold of each of the sounds f0, f1, and f2 (spectrum powers P0, P1, and P2) given by itself is calculated. To explain this with concrete descriptions, dthr0=w(f0)P0, dthr1=w(f1)P1, and dthr2=w(f2)P2. The masking threshold dthr(f0, f1) of the band f1 given by the sound f0 (with power "P0" and masking "M0") is then calculated. To explain this with concrete descriptions, dthr(f0, f1)=dthr0+SH(f0−f1). After that, the masking threshold dthr (f2, f1) of the band f1 given by the sound f2 (with power "P2" and masking "M2") is calculated. To explain this with concrete descriptions, dthr(f2, f1)=dthr2+SL(f2−f1). As a result, the higher value from among M1, M(f0, f1) and M(f2, f1) is set to be the new dynamic masking threshold of f1. More particularly, dthrA1=max(dthr1, dthr(f0, f1), dthr(f2, f1)). The new dynamic masking threshold is calculated across the entire band in the above-described same process.

Figure 5:
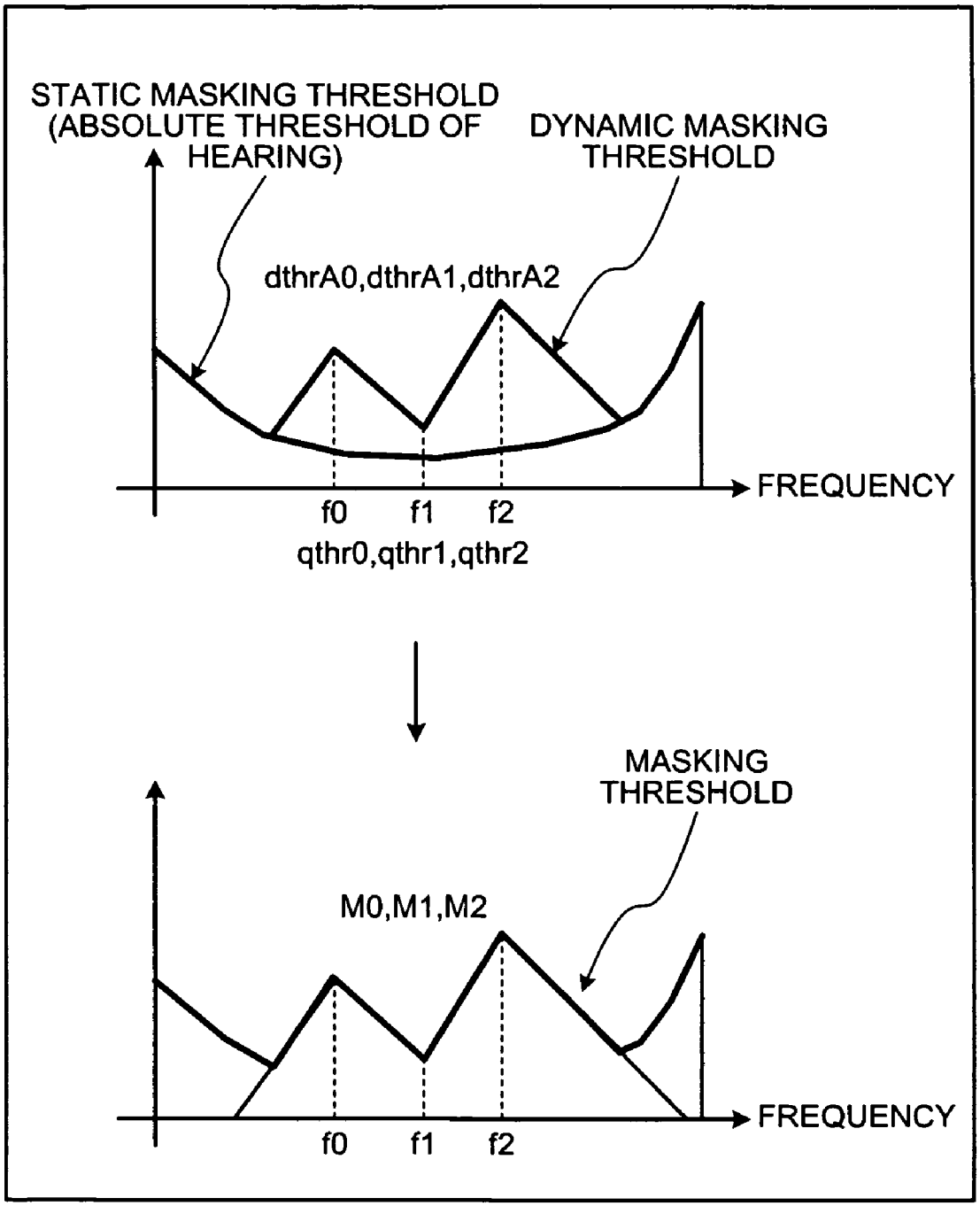
FIG. 5 is a schematic diagram illustrating calculation for the masking threshold.

The calculation of the masking threshold is described with reference to FIG. 5. FIG. 5 is a schematic diagram to explain calculation for the masking threshold. As illustrated in FIG. 5, the magnitude of the dynamic masking of f0, f1, and f2 are compared with the magnitude of the static masking. To explain this with concrete descriptions, the magnitude of the dynamic masking thresholds "dthrA0, dthrA1, and dthrA2" of f0, f1, and f2 is compared with the magnitude of the static masking thresholds "qthr0, qthr1, and qthr2" of f0, f1, and f2. The higher one of either the dynamic masking or the static masking is selected to be the masking threshold of the band. To explain this with concrete descriptions, M0=max(qthr0, dthrA0), M1=max(qthr1, dthrA1), and M2=max(qthr2, dthrA2). The masking threshold can be only either the dynamic masking or the static masking.

The correctable-segment searching unit 306 searches the area equal to or less than the calculated masking threshold for a correctable band. More particularly, the correctable-segment searching unit 306 searches the area equal to or less than the calculated masking threshold that is received from the masking-threshold calculating unit 305 for a segment that is obtained by comparing the spectrum power of each segment with the masking threshold. The correctable-segment searching unit 306 then determines the segment that is obtained by the search to be a correctable segment. After that, the correctable-segment searching unit 306 sends the determined correctable segment to the later-described correcting unit 307.

The correcting unit 307 determines an amount of correction (hereinafter, "correction amount") on the basis of the masking threshold to correct the band that is obtained by the search as the correctable segment and corrects the spectrum power of the correctable segment on the basis of the determined correction amount.

More particularly, upon receiving, from the correctable-segment searching unit 306, the band that is obtained by the search as the correctable segment, the correcting unit 307 compares the masking threshold of the correctable segment with the spectrum powers of segments adjacent to the correctable segment. The correcting unit 307 then determines a spectrum power of a band, from among the segments adjacent to the correctable segment, having the spectrum power equal to or less than the masking threshold to be the correction amount and corrects the spectrum power of the correctable segment on the basis of the determined correction amount. After that, the correcting unit 307 sends the corrected spectrum power to the later-described first quantizing unit 308.

The first quantizing unit 308 quantizes the spectrum power that is corrected by the correcting unit 307. After that, the first quantizing unit 308 sends the quantized spectrum power to the later-described first encoding unit 309.

The first encoding unit 309 encodes the quantized spectrum power. More particularly, the first encoding unit 309 performs the encoding so that the quantized spectrum power that is received from the first quantizing unit 308 is compressed based on a predetermined rule. After that, the first encoding unit 309 sends the encoded spectrum power to the later-described multiplexing unit 312.

The second quantizing unit 310 quantizes the feature parameter of the spectrum, which is data unreplicable from the low frequency component, that is calculated by the auxiliary-information calculating unit 304. After that, the second quantizing unit 310 sends the quantized feature parameter to the later-described second encoding unit 311.

The second encoding unit 311 encodes the quantized feature parameter. More particularly, the second encoding unit 311 performs the encoding so that the quantized feature parameter that is received from the second quantizing unit 310 is compressed based on a predetermined rule. After that, the second encoding unit 311 sends the encoded feature parameter to the later-described multiplexing unit 312.

The multiplexing unit 312 multiplexes the segment division data, the encoded spectrum power, and the encoded feature parameter. More particularly, the multiplexing unit 312 multiplexes the segment division data that is the division data about the segments received from the time/frequency-grid creating unit 302, the encoded spectrum power that is received from the first encoding unit 309, and the encoded feature parameter that is received from the second encoding unit 311. After that, the multiplexing unit 312 outputs the multiplex of the segment division data, the encoded spectrum power, and the encoded feature parameter, i.e., the SBR encoded data as an SBR output and sends it to the bitstream creating unit 400.

The bitstream creating unit 400 of the audio encoding apparatus 100 creates a bitstream by multiplexing the received AAC encoded data and the received SBR encoded data. More particularly, the bitstream creating unit 400 of the audio encoding apparatus 100 creates the HE-AAC bitstream by multiplexing the AAC encoded data and the SBR encoded data that are received from the AAC encoder 200 and the SBR encoder 300.

Flowchart of Bitstream Creating Process According to First Embodiment

Figure 6:
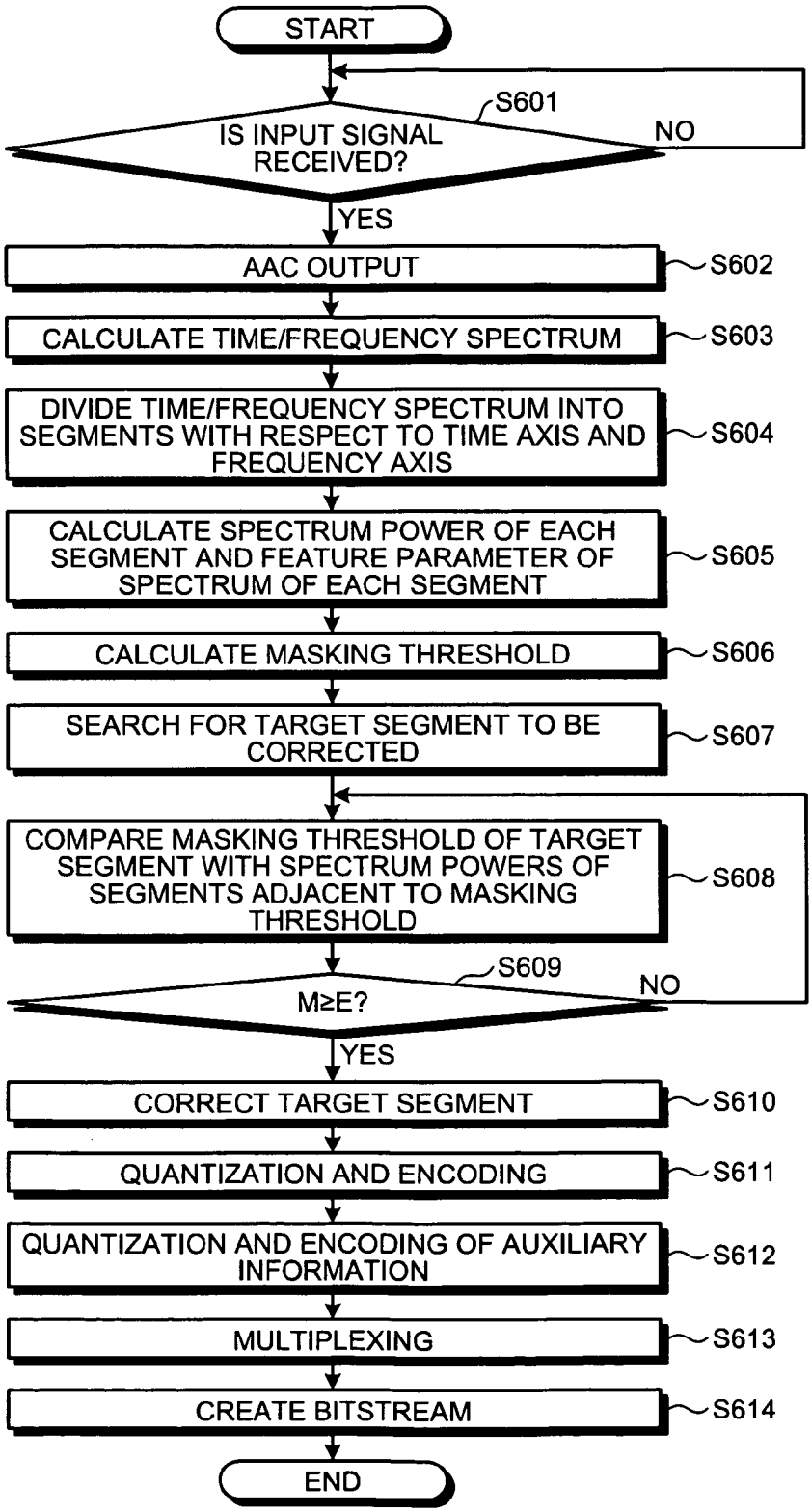
FIG. 6 is a flowchart of a bitstream creating process according to the first embodiment.

A bitstream creating process according to the first embodiment is described with reference to FIGS. 6 and 7A to 7E. FIG. 6 is a flowchart of the bitstream creating process according to the first embodiment. FIGS. 7A to 7E are graphs to explain a power correcting process according to the first embodiment.

As illustrated in FIG. 6, upon receiving an input signal (Yes at Step S601), the AAC encoder 200 of the audio encoding apparatus 100 downsamples the input signal, encodes a low frequency component that is obtained by the downsampling, and outputs AAC encoded data as an AAC output (Step S602).

More particularly, when the audio encoding apparatus 100 receives the input signal and then the low frequency component is obtained by downsampling the input signal, i.e., sampling the input signal at a lower frequency, the AAC encoder 200 of the audio encoding apparatus 100 encodes the low frequency component based on a predetermined rule so that the audio is compressed and outputs the AAC encoded data as an AAC output.

After that, upon receiving the input signal, the analyzing filter unit 301 converts the received input signal into a frequency-domain spectrum signal (Step S603). More particularly, when the audio encoding apparatus 100 receives the input signal, the analyzing filter unit 301 calculates the time/frequency spectrum of the received input signal and converts the input signal into the frequency-domain spectrum signal. The analyzing filter unit 301 converts the input signal into the spectrum signal and extracts a high frequency component that is to be encoded by the SBR encoder 300.

Figure 7A:
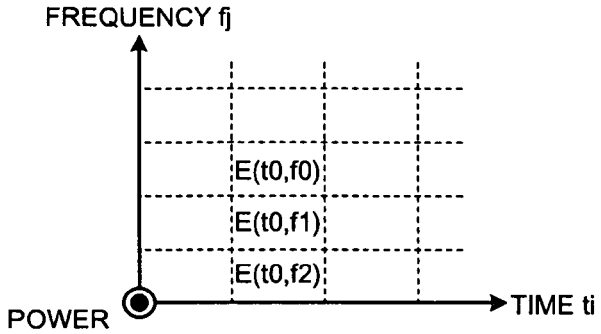
FIGS. 7A to 7E are graphs to explain a power correcting process according to the first embodiment.

After that, the time/frequency-grid creating unit 302 divides the spectrum signal that is obtained by the analyzing filter unit 301 into an arbitrary number of segments with respect to the time axis and the frequency axis (Step S604). More particularly, the time/frequency-grid creating unit 302 divides the frequency-domain spectrum signal that is obtained by the analyzing filter unit 301 into the arbitrary number of the segments with respect to the time axis and the frequency axis. For example, as illustrated in FIG. 7A, in the grid with respect to the time (ti) and the frequency (fj), the segments include E(t0, f0), E(t0, f1), and E(t0, f2), in which the number of segments in the time axis is "1" and the number of segments in the frequency axis is "3".

After that, the power calculating unit 303 calculates the spectrum power of each of the arbitrary number of segments that are obtained by the time/frequency-grid creating unit 302, and the auxiliary-information calculating unit 304 calculates the feature parameter of the spectrum of each of the arbitrary number of segments that are obtained by the time/frequency-grid creating unit 302 (Step S605).

Figure 7B:
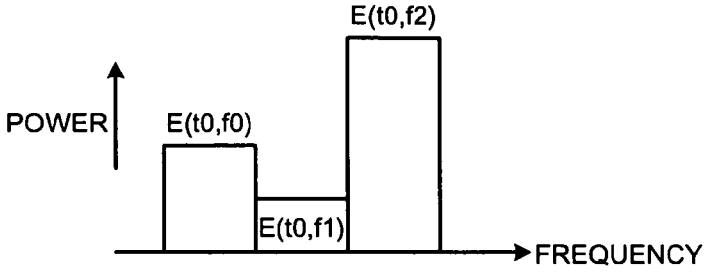

More particularly, the power calculating unit 303 creates the spectrum power of each of the arbitrary number of segments that are obtained by the time/frequency-grid creating unit 302. The auxiliary-information calculating unit 304 calculates, using the time/frequency spectrum and the resolution data, the feature parameter of the spectrum, which is data unreplicable from the low frequency component, of each of the arbitrary number of segments that are obtained by the time/frequency-grid creating unit 302. For example, as illustrated in FIG. 7B, the spectrum powers of the segments E(t0, f0), E(t0, f1), and E(t0, f2) illustrated in FIG. 7A are created. The graph of FIG. 7B illustrates a relation between the frequency and the power of the segments with the time "t0".

Figure 7C:
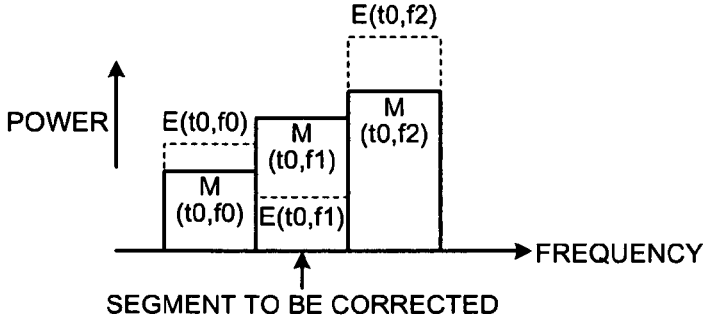

After that, the masking-threshold calculating unit 305 calculates the masking threshold using the spectrum power that is calculated by the power calculating unit 303 (Step S606). More particularly, the masking-threshold calculating unit 305 calculates, using the spectrum power that is calculated by the power calculating unit 303, the masking threshold that is obtained by combining a minimum sound level within the range of the human hearing in silence and a sound level at which the human cannot hear the sound because of interference by a too-high adjacent spectrum power. For example, as illustrated in FIG. 7C, the masking threshold of the powers E(t0, f0), E(t0, f1), and E(t0, f2) are M(t0, f0), M(t0, f1), and M(t0, f2), respectively.

After that, the correctable-segment searching unit 306 searches the area equal to or less than the calculated masking threshold for a correctable band (Step S607). More particularly, the correctable-segment searching unit 306 searches the area equal to or less than the masking threshold that is calculated by the masking-threshold calculating unit 305 for a segment that is obtained by comparing the spectrum power of each segment with the masking threshold and determines the segment that is obtained by the search to be the correctable segment.

After that, the correcting unit 307 determines the correction amount on the basis of the masking threshold to correct the band that is obtained by the search by the correctable-segment searching unit 306 as the correctable segment and corrects the spectrum power of the correctable segment on the basis of the determined correction amount (Steps S608 to S610).

More particularly, the correcting unit 307 compares the masking threshold (assumed to be, for example, "M") of the band that is obtained by the search by the correctable-segment searching unit 306 as the correctable segment with the spectrum powers (assumed to be, for example, "E") of segments adjacent to the correctable segment. The correcting unit 307 determines the spectrum power of a band, from among the segments adjacent to the correctable segment, having the spectrum power E equal to or less than the masking threshold M, i.e., M≧E to be the correction amount and corrects the spectrum power of the correctable segment on the basis of the determined correction amount.

Figure 7D:
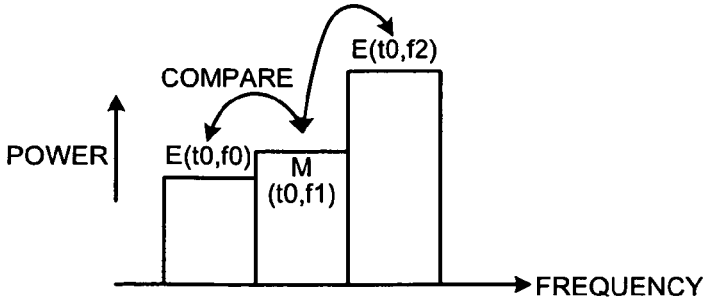
Figure 7E:
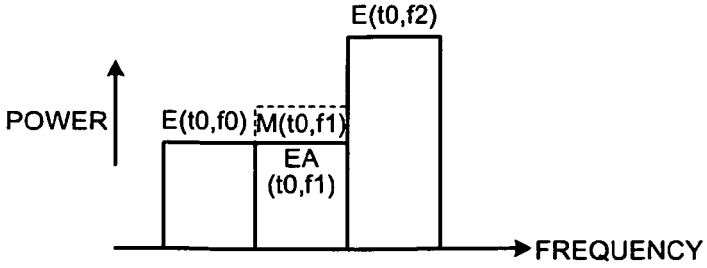

For example, as illustrated in FIG. 7D, the masking threshold M(t0, f1) of the correctable segment is compared with the spectrum powers E(t0, f0) and E(t0, f2) of the segments adjacent to the correctable segment. As a result of the comparison, as illustrated in FIG. 7E, E(t0, f0), which satisfies M(t0, f1) E(t0, f0), is determined to be the correction amount and the spectrum power of the correctable segment is corrected on the basis of the determined correction amount to EA(t0, f1).

After that, the first quantizing unit 308 quantizes the spectrum power that is corrected by the correcting unit 307. The first encoding unit 309 encodes the spectrum power that is quantized by the first quantizing unit 308 (Step S611).

More particularly, the first quantizing unit 308 performs the quantization so that the strength of the spectrum power that is corrected by the correcting unit 307 is converted to a numerical value (digital data). The first encoding unit 309 performs the encoding so that the spectrum power that is quantized by the first quantizing unit 308 is compressed based on a predetermined rule.

After that, the second quantizing unit 310 quantizes the feature parameter that is calculated by the auxiliary-information calculating unit 304. The second encoding unit 311 encodes the feature parameter that is quantized by the second quantizing unit 310 (Step S612).

More particularly, the second quantizing unit 310 performs the quantization so that the feature parameter, which is data unreplicable from the low frequency component, that is calculated by the auxiliary-information calculating unit 304 is converted to a numerical value (digital data). The second encoding unit 311 performs the encoding so that the feature parameter that is quantized by the second quantizing unit 310 is compressed based on a predetermined rule.

The multiplexing unit 312 multiplexes the segment division data that is created by the time/frequency-grid creating unit 302, the spectrum power that is encoded by the first encoding unit 309, and the feature parameter that is encoded by the second encoding unit 311 (Step S613).

More particularly, the multiplexing unit 312 multiplexes the segment division data that is created by the time/frequency-grid creating unit 302, the spectrum power that is encoded by the first encoding unit 309, and the feature parameter that is encoded by the second encoding unit 311.

After that, the bitstream creating unit 400 of the audio encoding apparatus 100 creates a bitstream by multiplexing the AAC encoded data and the SBR encoded data that are received from the AAC encoder 200 and the SBR encoder 300 (Step S614).

More particularly, the bitstream creating unit 400 of the audio encoding apparatus 100 creates the HE-AAC bitstream by multiplexing the AAC encoded data and the SBR encoded data that are received from the AAC encoder 200 and the SBR encoder 300.

Advantages of First Embodiment

As it has been mentioned in the first embodiment, the input signal is converted into the frequency-domain spectrum signal, the converted spectrum signal is divided into an arbitrary number of segments with respects to the time axis and the frequency axis, the spectrum power of each segment is calculated, the masking threshold is calculated using the calculated spectrum power of each segment, the segment having the spectrum power equal to or less than the calculated masking threshold is detected, and the spectrum power of the detected segment is corrected. This reduces the number of bits used in the SBR encoding.

If, for example, an HE-AAC encoding apparatus including an SBR encoder and an AAC encoder is used, when the SBR encoder creates a segment zone (time/frequency grid) by dividing the input signal into segments with respect to the time axis and the frequency axis depending on the property of the input signal, calculates the spectrum power within the created time/frequency grid and data unreplicable from the low frequency component, and quantizes them both, a spectrum power that is equal to or less than a masking threshold, i.e., spectrum power out of the range of the human hearing is corrected. This reduces a difference between the quantization values that are encoded using the Huffman coding. Because a shorter code is allocated as the difference between the quantization values decreases in the Huffman coding, this reduces the number of encoding bits. The reduction of the number of bits used in the SBR encoding leads to an increase of the number of bits available in the AAC encoding. Consequently, the quantization error in the AAC encoding is reduced, which improves total sound quality of data encoded using the HE-AAC encoding apparatus.

Moreover, as described in the first embodiment, the feature parameter of each segment, which represents the feature of the corresponding spectrum power, is calculated on the segment basis, and both the corrected spectrum power of the segment and the calculated feature parameter are encoded. This implements accurate SBR encoding without missing detailed information.

Furthermore, as described in the first embodiment, the correction amount is calculated using the spectrum power of the segment adjacent to the detected segment and the spectrum power of the detected segment is corrected by adding the calculated correction amount to the spectrum power of the detected segment. Therefore, only the range out of the human hearing is corrected.

[b] Second Embodiment

The manner of correction has been mentioned in the first embodiment in which the masking threshold of the target segment to be corrected is compared with the spectrum powers of the segments adjacent to the target segment. The present invention includes but not limited to the first embodiment. It is possible to correct the spectrum power by comparing the quantized or encoded spectrum power of the target segment with the quantized or encoded spectrum powers of the segments adjacent to the target segment.

In the following second embodiment, a case where the spectrum power is corrected by comparing the quantized or encoded spectrum power of the target segment to be corrected with the quantized or encoded spectrum powers of the segments adjacent to the target segment is described below with reference to FIG. 8.

Bitstream Creating Process According to Second Embodiment

Figure 8:
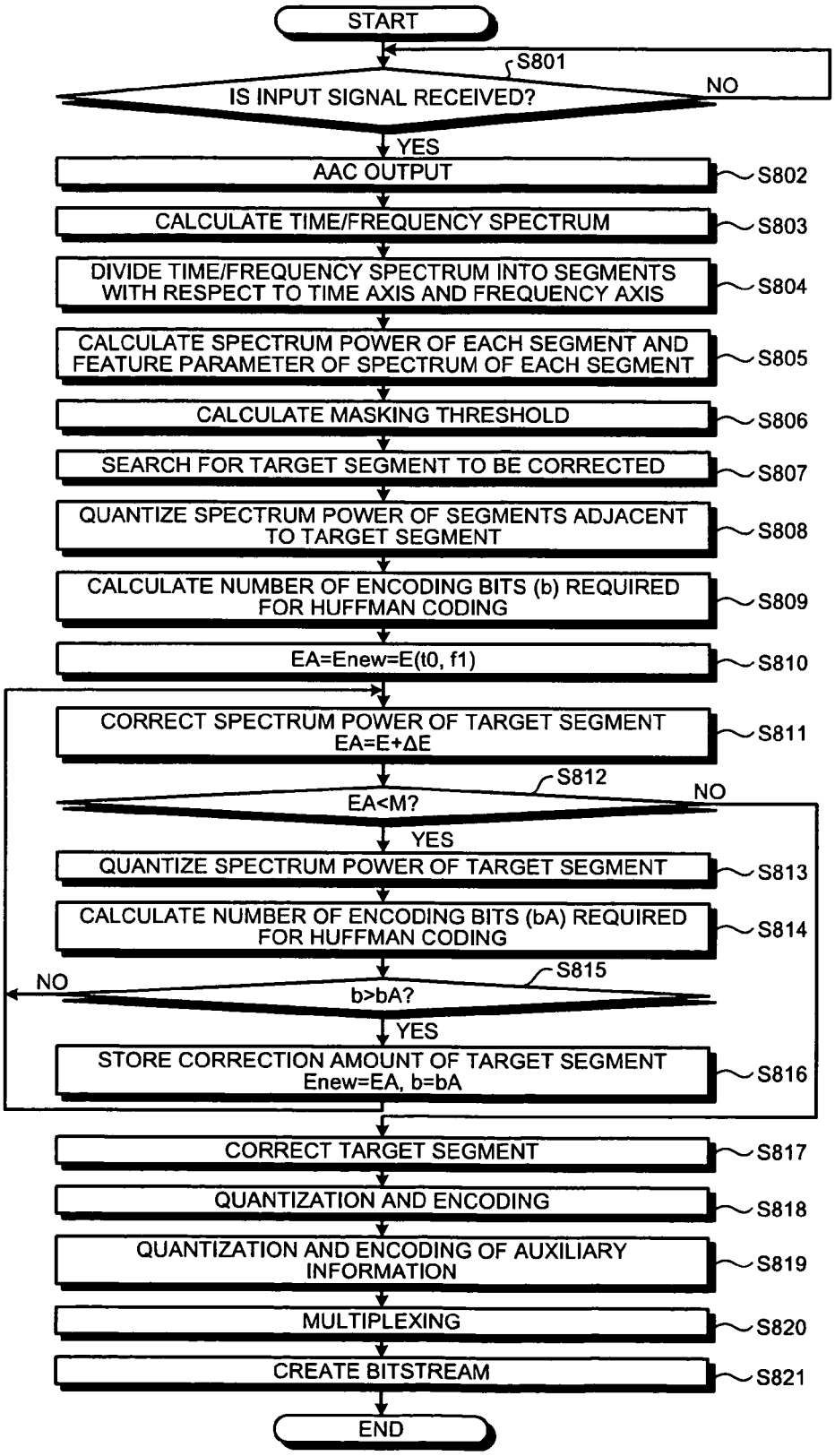
FIG. 8 is a flowchart of a bitstream creating process according to a second embodiment.

FIG. 8 is a flowchart of a bitstream creating process according to the second embodiment. Steps S801 to S807 of FIG. 8 are the same as Steps S601 to S607 of FIG. 6, and Steps S817 to S821 are the same as Steps S610 to S614 of FIG. 6; therefore, the same description is not repeated. In this example, the masking threshold of the correctable segment that is calculated at Step S806 is assumed to be "M(t0, f1)".

As illustrated in FIG. 8, after the correctable segment is obtained by the search from Steps S801 to S807, the SBR encoder 300 quantizes the spectrum powers of the segments adjacent to the band that is obtained by the search as the correctable segment (Step S808). More particularly, the SBR encoder 300 quantizes (digitalizes) not the spectrum power of the correctable segment but the spectrum powers of the segments adjacent to the correctable segment. Suppose, for example, there is a case where the correctable segment is "E(t0, f1)", and the segments adjacent to the correctable segment are "E(t0, f0)" and "E(t0, f2)". It is assumed that E(t0, f0)<E(t0, f2).

The SBR encoder 300 encodes the segments adjacent to the correctable segment having the quantized spectrum powers using the Huffman coding and calculates the number of encoding bits (Step S809). More particularly, the SBR encoder 300 encodes the segments adjacent to the correctable segment having the quantized spectrum powers using the Huffman coding, which is lossless compression without missing any part of data, and calculates the number of encoding bits of each segment. It is assumed that the number of encoding bits is calculated to "b".

After that, the SBR encoder 300 sets the correctable segment "E(t0, f1)" to "EA=Enew=E(t0, f1)" (Step S810) and corrects the spectrum power of the correctable segment (Step S811). More particularly, the SBR encoder 300 sets the correctable segment "E(t0, f1)" to "EA=Enew" and corrects the spectrum power of the correctable segment "EA" ("EA=E+ΔE"). The value ΔE is an amount of power conversion that changes the quantization value of the segment by "1". The amount of change of ΔE can be either positive or negative.

After that, the SBR encoder 300 compares the corrected correctable segment "EA" with the masking threshold "M" and quantizes, if the correctable segment "EA" is less than the masking threshold "M" (EA<M) (Yes at Step S812), the spectrum power of the correctable segment (Step S813).

More particularly, the SBR encoder 300 compares the correctable segment "EA" after correction with the masking threshold "M(t0, f1)" of the correctable segment that is calculated at Step S806. If the correctable segment "EA" is less than the calculated masking threshold "M" of the correctable segment (EA<M), the correctable segment is determined to be the lower limit of the range of the human hearing or lower, i.e., determined to be the segment to be corrected; therefore, the SBR encoder 300 quantizes the spectrum power of the correctable segment. If it is determined at Step S812 that the correctable segment "EA" is higher than the masking threshold "M" (No at Step S812), the SBR encoder 300 performs the process of Step S817.

The SBR encoder 300 encodes the correctable segment having the quantized spectrum power using the Huffman coding and calculates the number of encoding bits (Step S814). More particularly, the SBR encoder 300 encodes the correctable segment having the quantized spectrum power using the Huffman coding, which is lossless compression without missing any part of data, and calculates the number of encoding bits "bA" of the correctable segment.

After that, the SBR encoder 300 compares the number of encoding bits "b" of the correctable segment before correction with the number of encoding bits "bA" of the correctable segment after correction and stores therein, if "b" before correction is higher than "bA" after correction (b>bA) (Yes at Step S815), the correction amount of the band of the correctable segment (Step S816).

More particularly, the SBR encoder 300 compares the number of encoding bits "b" of the correctable segment before correction with the number of encoding bits "bA" of the correctable segment after correction. If "b" before correction is higher than "bA" after correction (b>bA), the SBR encoder 300 stores therein "bA" associated with the band of the correctable segment. In this example, "Enew=EA" and "b=bA" are stored therein. If it is determined at Step S815 that "b" before correction is less than "bA" after correction, the SBR encoder 300 performs the processes of Step S811 and the subsequent steps. When the process of Step S816 is completed, the SBR encoder 300 also performs the processes of Step S811 and the subsequent steps.

Advantages of Second Embodiment

As it has been mentioned in the second embodiment, the quantization value is calculated from the spectrum power of the segments adjacent to the detected segment as the correction amount to correct the spectrum power of the detected segment, and the spectrum power of the detected segment is corrected using the calculated quantization value. This further reduces the number of bits used in the SBR encoding.

[c] Third Embodiment

The manner of correction has been mentioned in the first embodiment in which the masking threshold of the target segment to be corrected is compared with the spectrum powers of the segments adjacent to the target segment. The present invention includes but not limited to the first embodiment. It is possible to correct the target segment by quantizing the spectrum power of the target segment before correction and then comparing the quantized spectrum power with the quantized masking threshold of the target segment.

In the following third embodiment, a case where the spectrum power of the target segment to be corrected is quantized before correction, and the quantized spectrum power is then compared with the quantized masking threshold of the target segment is described with reference to FIGS. 9 and 10.

Configuration of Audio Encoding Apparatus According to Third Embodiment

Figure 9:
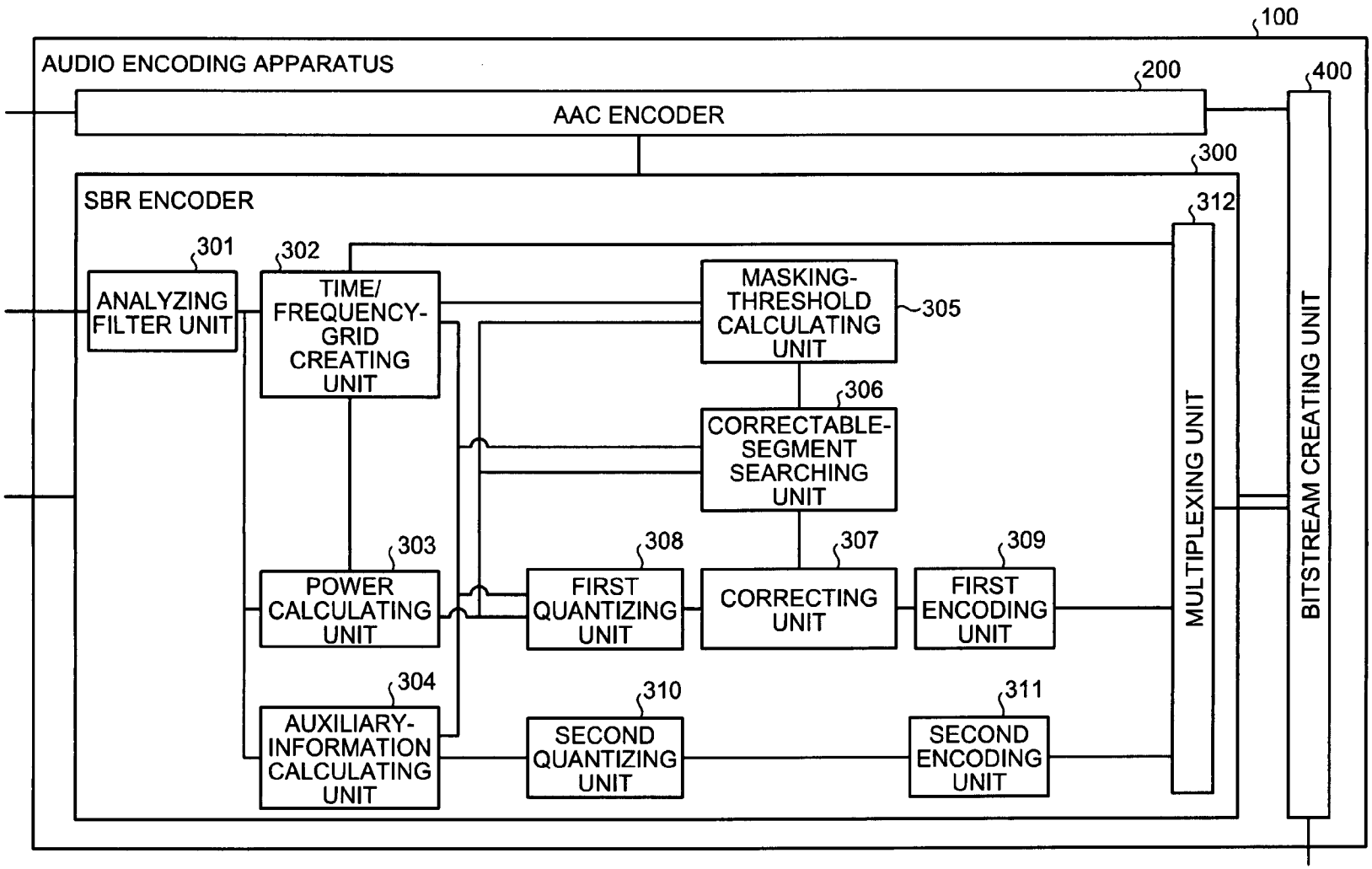
FIG. 9 is a block diagram of the configuration of an audio encoding apparatus according to a third embodiment.

FIG. 9 is a block diagram of the configuration of an audio encoding apparatus according to the third embodiment. As illustrated in FIG. 9, the audio encoding apparatus 100 includes the AAC encoder 200, the SBR encoder 300, and the bitstream creating unit 400.

The audio encoding apparatus 100 according to the third embodiment is different from that according to the first embodiment in that the spectrum power of the target segment to be corrected is quantized before correction. The audio encoding apparatus 100 according to the third embodiment has the same functional configuration and performs the same processes as the first embodiment; therefore, the same description is not repeated.

The power calculating unit 303 in the first embodiment sends the calculated spectrum power to the correcting unit 307. The power calculating unit 303 in the third embodiment, in contrast, sends the calculated spectrum power to the first quantizing unit 308.

The first quantizing unit 308 quantizes the calculated spectrum power. More particularly, the first quantizing unit 308 quantizes the calculated spectrum power before correction of the correctable segment that is received from the power calculating unit 303 and sends the quantized spectrum power to the correcting unit 307.

The correcting unit 307 determines, as for the band that is obtained by the search as the correctable segment, the correction amount by comparing the quantization value of the spectrum power of the correctable segment with the quantization value of the masking threshold of the correctable segment and then corrects the spectrum power on the basis of the determined correction amount.

More particularly, the correcting unit 307 compares, as for the band that is obtained by the search as the correctable segment, the value that is obtained by increasing/decreasing by "1" the quantization value of the spectrum power of the correctable segment that is quantized by the first quantizing unit 308 with the quantization value of the masking value of the correctable segment. If the quantization value of the spectrum power of the correctable segment is less than the quantization value of the masking value of the correctable segment and the number of encoding bits is reduced after the Huffman coding, the correcting unit 307 determines the value to be the correction amount and corrects the quantization value of the spectrum power of the correctable segment on the basis of the determined correction amount. After that, the correcting unit 307 sends the quantization value of the corrected spectrum power to the first encoding unit 309.

Flowchart of Bitstream Creating Process According to Third Embodiment

A bitstream creating process according to the third embodiment is described below with reference to FIG. 10. FIG. 10 is a flowchart of the bitstream creating process according to the third embodiment. Steps S1001 to S1007 of FIG. 10 are the same as Steps S601 to S607 of FIG. 6, and Steps S1017 to S1021 are the same as Steps S610 to S614 of FIG. 6; therefore, the same description is not repeated. In this example, the quantization value of the masking threshold of the correctable segment that is calculated at Step S1006 is assumed to be "Mq".

Figure 10:
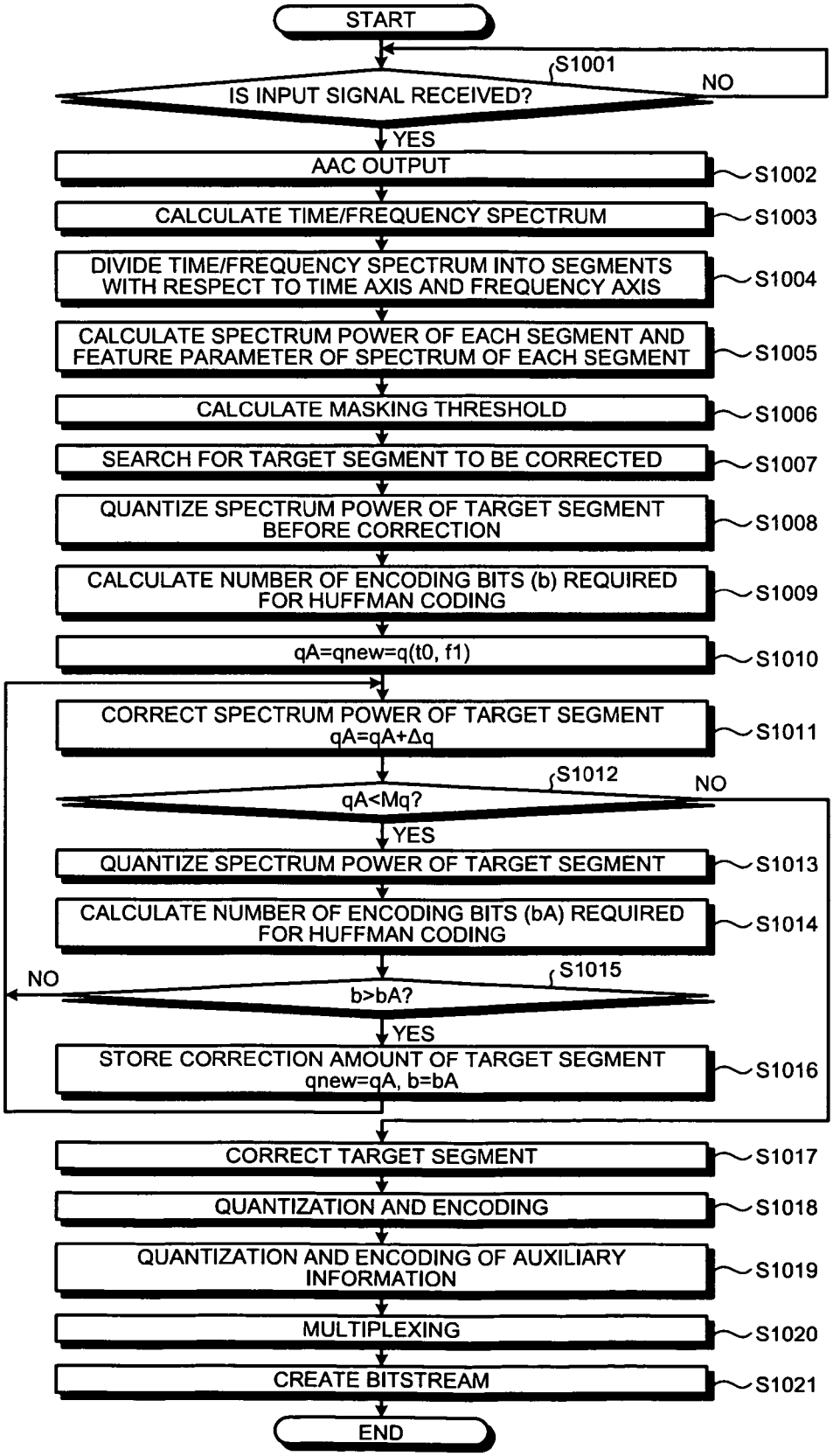
FIG. 10 is a flowchart of a bitstream creating process according to the third embodiment.

As illustrated in FIG. 10, after the correctable segment is obtained by the search from Steps S1001 to S1007, the SBR encoder 300 quantizes, before correction, the spectrum power of the band that is obtained by the search as the correctable segment (Step S1008). More particularly, the SBR encoder 300 quantizes (digitalizes), before correction, the spectrum power of the band that is obtained by the search as the correctable segment. Suppose, for example, there is a case where the quantization value of the correctable segment is "q(t0, f1)", and the segments adjacent to the correctable segment are "q(t0, f0)" and "q(t0, f2)". It is assumed that q(t0, f0)<q(t0, f2).

The SBR encoder 300 encodes the band of the correctable segment having the quantized spectrum power using the Huffman coding and calculates the number of encoding bits (Step S1009). More particularly, the SBR encoder 300 encodes the band of the correctable segment having the quantized spectrum power using the Huffman coding, which is lossless compression without missing any part of data, and calculates the number of encoding bits of the band of the correctable segment. It is assumed that the number of encoding bits is calculated to "b".

After that, the SBR encoder 300 sets the quantization value of the correctable segment "q(t0, f1)" to "qA=qnew=q(t0, f1)" (Step S1010) and corrects the spectrum power of the correctable segment (Step S1011). More particularly, the SBR encoder 300 sets the quantization value of the correctable segment "q(t0, f1)" to "qA=qnew" and corrects the spectrum power of the quantization value "qA" of the correctable segment ("qA=qA+Δq"). The value Δq can be set to correct the quantization value by an increment of 1 or N (an arbitrary integer). The amount of conversion of Δq can be either positive or negative.

After that, the SBR encoder 300 compares the quantization value "qA" of the correctable segment after correction with the quantization value "Mq" of the masking threshold and quantizes, if the quantization value "qA" of the correctable segment is less than the quantization value "Mq" of the masking threshold (qA<Mq) (Yes at Step S1012), the spectrum power of the correctable segment (Step S1013).

More particularly, the SBR encoder 300 compares the quantization value "qA" of the correctable segment after correction with the quantization value "Mq" of the masking threshold of the correctable segment that is calculated at Step S1006. If the quantization value "qA" of the correctable segment is less than the calculated quantization value "Mq" of the masking threshold of the correctable segment (qA<Mq), the correctable segment is determined to be the lower limit of the range of the human hearing or lower, i.e., determined to be the segment to be corrected; therefore, the SBR encoder 300 quantizes the spectrum power of the correctable segment. In this case, the quantization value of the spectrum power of the correctable segment is equal to "qA" because the correctable segment is obtained by the search of the area of the quantization values. If the quantization value "qA" of the correctable segment is higher than the quantization value "Mq" of the masking threshold (No at Step S1012), the SBR encoder 300 performs the process of Step S1017.

The SBR encoder 300 encodes the correctable segment having the quantized spectrum power using the Huffman coding and calculates the number of encoding bits (Step S1014). More particularly, the SBR encoder 300 encodes the correctable segment having the quantized spectrum power using the Huffman coding, which is lossless compression without missing any part of data, and calculates the number of encoding bits "bA" of the correctable segment.

After that, the SBR encoder 300 compares the number of encoding bits "b" of the correctable segment before correction with the number of encoding bits "bA" of the correctable segment after correction and stores therein, if "b" before correction is higher than "bA" after correction (b>bA) (Yes at Step S1015), the correction amount of the band of the correctable segment (Step S1016).

More particularly, the SBR encoder 300 compares the number of encoding bits "b" of the correctable segment before correction with the number of encoding bits "bA" of the correctable segment after correction. If "b" before correction is higher than "bA" after correction (b>bA), the SBR encoder 300 stores therein "bA" associated with the band of the correctable segment. In this example, "qnew=qA" and "b=bA" are stored therein. If it is determined at Step S1015 that "b" before correction is less than "bA" after correction, the SBR encoder 300 performs the processes of Step S1011 and the subsequent steps. When the process of Step S1016 is completed, the SBR encoder 300 also performs the processes of Step S1011 and the subsequent steps.

Advantages of Third Embodiment

As it has been mentioned in the third embodiment, the correction amount is calculated on the basis of the calculated masking threshold so that the quantization value of the spectrum power of each segment becomes smoothed, and the spectrum power of the detected segment is corrected using the calculated correction amount. This reduces the difference between the quantization values that are encoded using the Huffman coding after correction.

[d] Fourth Embodiment

The present invention can be implemented by, in addition to the above-described embodiment, some other embodiments. In the following section, different embodiments are described with the various categories including (1) coding algorism, (2) manner of correction, (3) system configuration, and (4) computer programs.

(1) Coding Algorism

Although, for example, the encoding with respect to the frequency axis has been mentioned in the first, the second, and the third embodiments, the present invention is not limited thereto. The present invention can be applied to, for example, encoding of a grid adjacent with respect to the time axis.

(2) Manner of Correction

Although, for example, the quantization value is calculated using the spectrum power of the adjacent segment or the spectrum power of the correctable segment and the calculated quantization value is set to the correction amount in the first, the second, and the third embodiments, the present invention is not limited thereto. In the determination of the correction amount, it is allowable to determine the correction amount or the quantization value to be any value within the range of the masking threshold. Moreover, it is allowable to determine the correction amount or the quantization value to be a value within the range of the masking threshold so that the number of bits decreases as much as possible. This makes it possible to decrease the number of bits required for the correction as much as possible and decrease the difference between the quantization values that are encoded using the Huffman coding after the correction.

(3) System Configuration

The processing procedures, the control procedures, specific names, various data, and information including parameters (e.g., "masking threshold" illustrated in FIG. 2) described in the embodiments or illustrated in the drawings can be changed as required unless otherwise specified.

The constituent elements of the device illustrated in the drawings are merely conceptual, and need not be physically configured as illustrated. The constituent elements, as a whole or in part, can be separated or integrated either functionally or physically based on various types of loads or use conditions. For example, it is allowable to design a correcting unit by combining the correctable-segment searching unit 306 and the correcting unit 307. The process functions performed by the device are entirely or partially realized by a central processing unit (CPU) or computer programs that are analyzed and executed by the CPU, or realized as hardware by wired logic.

(4) Program

Figure 11:
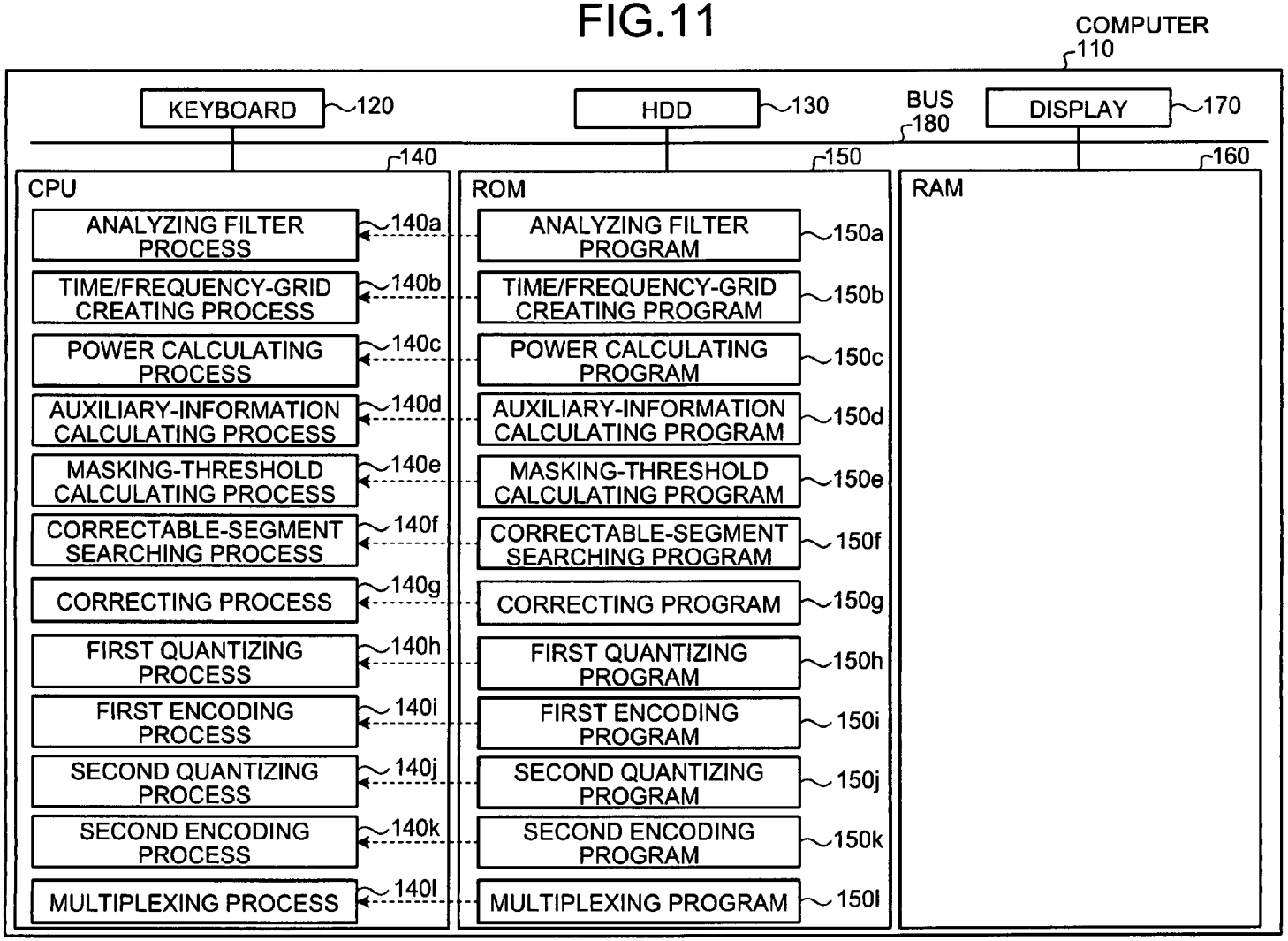
FIG. 11 is a block diagram of a computer that executes an audio encoding program.
Figure 12:
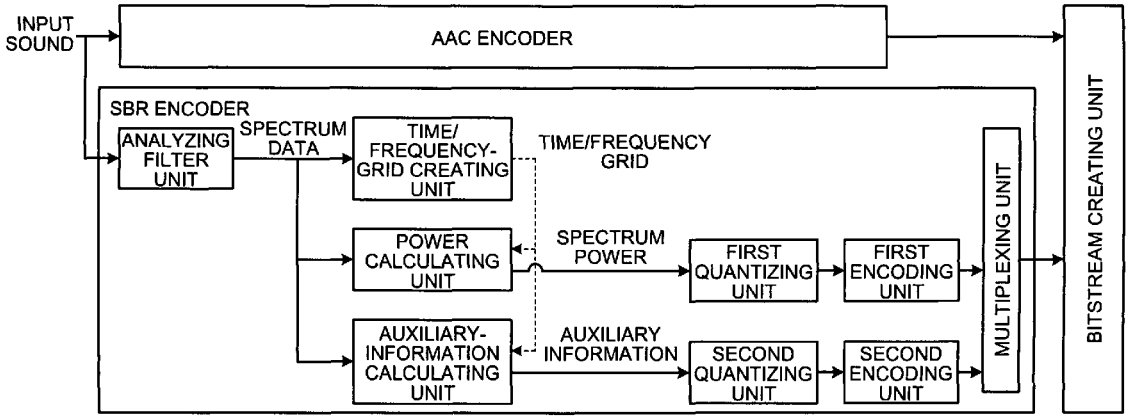
FIG. 12 is a block diagram of the configuration of a conventional HE-AAC encoding apparatus.

The audio encoding apparatus according to the present embodiment is implemented when certain computer programs are executed by a computer, such as a personal computer and a workstation. In the following section, an example of a computer that executes an audio encoding program so that the computer implements the same functions as the audio encoding apparatus described in any of the above embodiments has is described with reference to FIG. 11. FIG. 11 is a block diagram of the computer that executes the audio encoding program.

As illustrated in FIG. 11, a computer 110 that works as the audio encoding apparatus includes a keyboard 120, a hard disk drive (HDD) 130, a CPU 140, a read only memory (ROM) 150, a random access memory (RAM) 160, and a display 170, those connected to each other via a bus 180.

The ROM 150 stores therein the audio encoding program that implements the same functions as the audio encoding apparatus 100 according to the first embodiment has. The audio encoding program includes, as illustrated in FIG. 11, an analyzing filter program 150*a*, a time/frequency-grid creating program 150*b*, a power calculating program 150*c*, an auxiliary-information calculating program 150*d*, a masking-threshold calculating program 150*e*, a correctable-segment searching program 150*f*, a correcting program 150*g*, a first quantizing program 150*h*, a first encoding program 150*i*, a second quantizing program 150*j*, a second encoding program 150*k*, and a multiplexing program 150*l*. These computer programs 150*a* to 150*l* can be separated or integrated, if required.

The CPU 140 reads these computer programs 150*a* to 150*l* from the ROM 150 and executes the obtained computer programs, thereby implementing an analyzing filter process 140*a*, a time/frequency-grid creating process 140*b*, a power calculating process 140*c*, an auxiliary-information calculating process 140*d*, a masking-threshold calculating process 140*e*, a correctable-segment searching process 140*f*, a correcting process 140*g*, a first quantizing process 140*h*, a first encoding process 140*i*, a second quantizing process 140*j*, a second encoding process 140*k*, and a multiplexing process 140*l*. The processes 140*a* to 140*l* correspond to the analyzing filter unit 301, the time/frequency-grid creating unit 302, the power calculating unit 303, the auxiliary-information calculating unit 304, the masking-threshold calculating unit 305, the correctable-segment searching unit 306, the correcting unit 307, the first quantizing unit 308, the first encoding unit 309, the second quantizing unit 310, the second encoding unit 311, and the multiplexing unit 312, respectively.

The CPU 140 executes the audio encoding program using data stored in the RAM 160.

It is not necessary to store the computer programs 150*a* to 150*l* in the ROM 150 in advance. The computer programs 150*a* to 150*l* can be stored in, for example, a "portable physical medium", such as a flexible disk (FD), a compact disk-read only memory (CD-ROM), a digital versatile disk (DVD), a magneto-optical disk, and an integrated circuit card (IC card), a "stationary physical medium", such as an HDD embedded in the computer 110 or an external HDD connected to the computer 110, or "another computer (or server)" that is connected to the computer 110 via the public line, the Internet, a local area network (LAN), a wide area network (WAN), or the like. The computer 110 reads the computer programs from the recording medium and executes the obtained computer programs.

According to an embodiment, it is possible to encode data using a plurality of combinations.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An encoding apparatus for dividing an input signal into frames that are formed from samples and creating high-frequency-component encoded data by encoding a high frequency band in the input signal, the encoding apparatus comprising:

a dividing unit that converts the input signal into a frequency-domain spectrum signal and divides the frequency-domain spectrum signal into an arbitrary number of segments with respect to a time axis and a frequency axis;

a threshold calculating unit that calculates a spectrum power of each of the segments and calculates a masking threshold using the calculated spectrum power of each segment; and a power correcting unit that detects a segment having the spectrum power equal to or less than the calculated masking threshold and corrects the spectrum power of the detected segment by calculating a correction amount using the spectrum power of a segment that is adjacent to the detected segment to correct the spectrum power of the detected segment and then adding the calculated correction amount to the spectrum power of the detected segment.

2. The encoding apparatus according to claim 1, further comprising:

a parameter calculating unit that calculates a feature parameter using the spectrum power of each of the segments, the feature parameter representing a feature of a corresponding spectrum power; and an encoding unit that encodes the corrected spectrum power and the calculated feature parameter.

3. The encoding apparatus according to claim 1, wherein the power correcting unit corrects the spectrum power by calculating a correction amount using the calculated masking threshold so that the spectrum powers of the segments become smoothed and then adding the calculated correction amount to the spectrum power of the detected segment.

4. The encoding apparatus according to claim 1, wherein the power correcting unit calculates the correction amount within a range of the calculated masking threshold.

5. The encoding apparatus according to claim 1, wherein the power correcting unit calculates the correction amount within a range of the calculated masking threshold so that high-frequency-component encoded data is created with a lower number of encoding bits.

6. The encoding apparatus according to claim 1, wherein the threshold calculating unit calculates the spectrum power of each of the segments, and calculates the masking threshold with respect to either the time axis or the frequency axis or both the time axis and the frequency axis using the calculated spectrum power of each segment.

7. An encoding apparatus for dividing an input signal into frames that are formed from samples and creating high-frequency-component encoded data by encoding a high frequency band in the input signal, the encoding apparatus comprising:

a dividing unit that converts the input signal into a frequency-domain spectrum signal and divides the frequency-domain spectrum signal into an arbitrary number of segments with respect to a time axis and a frequency axis;

a threshold calculating unit that calculates a spectrum power of each of the segments and calculates a masking threshold using the calculated spectrum power of each segment; and a power correcting unit that detects a segment having the spectrum power equal to or less than the calculated masking threshold and corrects the spectrum power of the detected segment by calculating a quantization value as a correction amount using the spectrum power of a segment that is adjacent to the detected segment to correct the spectrum power of the detected segment and then correcting the spectrum power of the detected segment using the calculated quantization value.

8. The encoding apparatus according to claim 7, wherein the power correcting unit calculates the quantization value within a range of the calculated masking threshold.

9. The encoding apparatus according to claim 7, wherein the power correcting unit calculates the quantization value within a range of the calculated masking threshold so that high-frequency-component encoded data is created with a lower number of encoding bits.

10. The encoding apparatus according to claim 7, further comprising:

a parameter calculating unit that calculates a feature parameter using the spectrum power of each of the segments, the feature parameter representing a feature of a corresponding spectrum power; and an encoding unit that encodes the corrected spectrum power and the calculated feature parameter.

11. The encoding apparatus according to claim 7, wherein the threshold calculating unit calculates the spectrum power of each of the segments, and calculates the masking threshold with respect to either the time axis or the frequency axis or both the time axis and the frequency axis using the calculated spectrum power of each segment.

12. An encoding apparatus for dividing an input signal into frames that are formed from samples and creating high-frequency-component encoded data by encoding a high frequency band in the input signal, the encoding apparatus comprising:

a dividing unit that converts the input signal into a frequency-domain spectrum signal and divides the frequency-domain spectrum signal into an arbitrary number of segments with respect to a time axis and a frequency axis;

a threshold calculating unit that calculates a spectrum power of each of the segments and calculates a masking threshold using the calculated spectrum power of each segment; and a power correcting unit that detects a segment having the spectrum power equal to or less than the calculated masking threshold and corrects the spectrum power of the detected segment by calculating a correction amount using the calculated masking threshold so that quantization values of the spectrum powers of the segments become smoothed and then correcting the spectrum power of the detected segment using the calculated correction amount.

13. The encoding apparatus according to claim 12, further comprising:

a parameter calculating unit that calculates a feature parameter using the spectrum power of each of the segments, the feature parameter representing a feature of a corresponding spectrum power; and an encoding unit that encodes the corrected spectrum power and the calculated feature parameter.

14. The encoding apparatus according to claim 12, wherein the threshold calculating unit calculates the spectrum power of each of the segments, and calculates the masking threshold with respect to either the time axis or the frequency axis or both the time axis and the frequency axis using the calculated spectrum power of each segment.

15. An encoding method for dividing an input signal into frames that are formed from samples and creating high-frequency-component encoded data by encoding a high frequency band in the input signal, the encoding method comprising:

converting the input signal into a frequency-domain spectrum signal;

dividing the frequency-domain spectrum signal into an arbitrary number of segments with respect to a time axis and a frequency axis;

calculating a spectrum power of each of the segments;

calculating a masking threshold using the calculated spectrum power of each segment;

detecting a segment having the spectrum power equal to or less than the calculated masking threshold; and correcting the spectrum power of the detected segment by calculating a correction amount using the spectrum power of a segment that is adjacent to the detected segment to correct the spectrum power of the detected segment and then adding the calculated correction amount to the spectrum power of the detected segment.

16. A non-transitory computer readable storage medium having stored therein an encoding program for implementing an encoding method for dividing an input signal into frames that are formed from samples and creating high-frequency-component encoded data by encoding a high frequency band in the input signal, the encoding program causing a computer to execute a process comprising:

converting the input signal into a frequency-domain spectrum signal;

dividing the frequency-domain spectrum signal into an arbitrary number of segments with respect to a time axis and a frequency axis;

calculating a spectrum power of each of the segments;

calculating a masking threshold using the calculated spectrum power of each segment;

detecting a segment having the spectrum power equal to or less than the calculated masking threshold; and correcting the spectrum power of the detected segment by calculating a correction amount using the spectrum power of a segment that is adjacent to the detected segment to correct the spectrum power of the detected segment and then adding the calculated correction amount to the spectrum power of the detected segment.

* * * * *